United States Patent [19]

Ahrweiler

[11] 4,200,430

[45] Apr. 29, 1980

[54] APPARATUS FOR THE MANUFACTURE OF SHEETS

[75] Inventor: Karl-Heinz Ahrweiler, Krefeld, Fed. Rep. of Germany

[73] Assignee: Eduard Küsters, Krefeld, Fed. Rep. of Germany

[21] Appl. No.: 925,796

[22] Filed: Jul. 18, 1978

[30] Foreign Application Priority Data

Aug. 6, 1977 [DE] Fed. Rep. of Germany ..... 2735510

[51] Int. Cl.[2] ..... B28B 5/00

[52] U.S. Cl. ..... 425/81.1; 425/83.1

[58] Field of Search ..... 425/80, 81, 83, 81.1, 425/83.1

[56] References Cited

U.S. PATENT DOCUMENTS

| | | | |
|---|---|---|---|
| 3,096,542 | 7/1963 | Fischer et al. | 425/81.1 |
| 4,099,296 | 7/1978 | Gustavsson | 156/62.2 |

*Primary Examiner*—Donald J. Arnold
*Assistant Examiner*—James R. Hall
*Attorney, Agent, or Firm*—Kenyon & Kenyon

[57] ABSTRACT

A stratified layer, for the manufacture of sheets, is formed from finely divided particles of material exhibiting a size distribution such as chips, fibers or the like, especially for the manufacture of wood chip panels, by forming a stratified mat on a substantially horizontal advancing surface by spraying particles of the material thereon, in such a manner that the finest particles are at at least one surface of the mat, through imparting a motion parallel to the direction of advance of the surface to the particles which are falling, causing the motion of individual particles to differ depending on the coarseness thereof so that different particles follow different parabolic trajectories and by collecting and removing particles which fall at least approximately vertically during said spraying.

5 Claims, 1 Drawing Figure

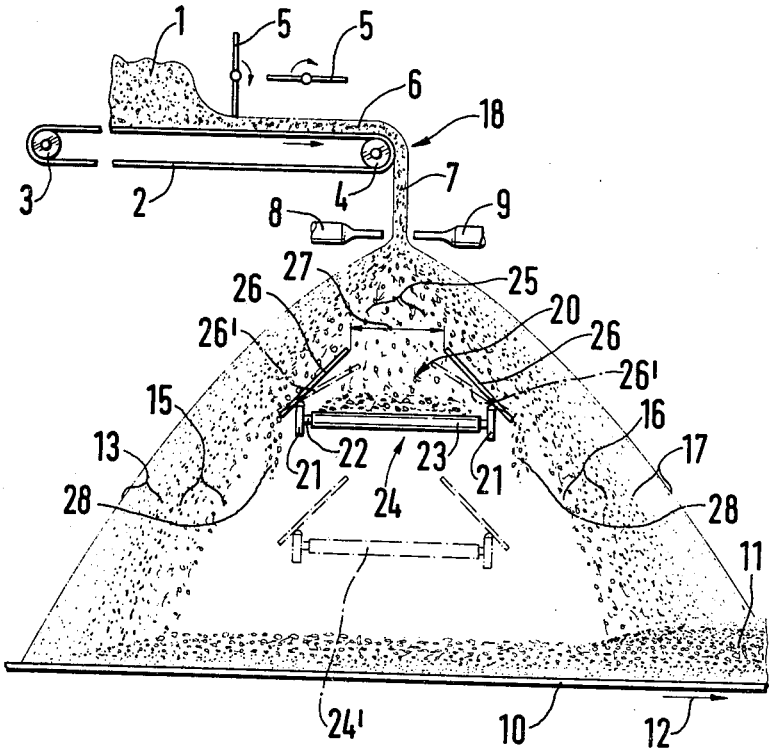
1
5
5
6
18
3
2
4
7
8
9
27
25
26
20
26
26'
26'
15
16
13
17
21
22
23
21
28
24
28
11
24'
10
12

APPARATUS FOR THE MANUFACTURE OF SHEETS

BACKGROUND OF THE INVENTION

This invention relates to an apparatus of manufacturing sheets from finely divided material exhibiting a size distribution, such as chips, fibers or the like, especially for the manufacture of wood chip panels, in general and more particularly to an improved method of this type.

A manufacturing method of this general type in which the excessively coarse particles are separated out and a substantially horizontally advancing, a stratified mat is formed from the remaining particles by spraying, in such a manner that the finer particles get to the upper and/or underside of the mat, and in which the stratification is produced by imparting a motion component to the falling particles, which is parallel to the forward direction of the mat and differs depending on the coarseness of the particles and thereby, causes different falling tragectories to be forced thereon, and in which the stratified mat is subsequently subjected to surface pressure, as well as to corresponding apparatus, is known.

The finely divided material used for the manufacture of the sheets does not consist of uniform particles. Rather, all possible sizes of, for instance, chips are represented in accordance with a random distribution within a certain size range. Among them are also chips and pieces of wood which are so large that they would interfere with the desired structure of the sheet. These chips must therefore be sorted out before they get to the mat which is formed by sprinkling on an advancing belt. The material is therefore subjected to a sifting operation, in which the excessively coarse particles are separated out.

Customarily, this sifting operation precedes the spraying process proper. It can consist, for example, of an air separator, in which the particles are allowed to drop onto a conveyor belt from a delivery zone which is situated above the conveyor belt and extends over the entire width of the latter. The dropping particles obtain a motion component parallel to the forward travel direction of the belt by means of an air nozzle arrangement disposed below the delivery zone above the conveyor belt. The lightest particles are deflected farthest by the air and the heaviest particles drop substantially vertically and are deflected hardly at all. In the striking range of these particles, a collecting device is provided which collects and removes the heaviest particles before they get on the conveyor belt which transports the other particles away. From this conveyor belt, the mixture of the lighter particles then goes into the sprinkling device, in which the stratified mat is formed. Other sifting devices are also known.

The initial sifting operation results in substantial additional cost.

SUMMARY OF THE INVENTION

It is an object of the present invention to reduce the complexity of the apparatus required for separating out the excessively coarse particles.

According to the present invention, to solve this problem, the particles which fall vertically or in an almost vertical range, are removed during the sprinkling operation used for building up the mat, before they reach the mat.

This saves the separate preceding sifting operation, and gives advantages not only with respect to the amount of apparatus required but also with respect of the space required. With the present invention, the sifting and the sprinkling operations take place in a single process. It is not tied to a specific sprinkling device. It can be applied to sprinkling devices operating according to the air sifter principle as well as, for instance, to sprinkling devices with scoop wheels. It is important only that the sprinkling device be one which spreads out the particles horizontally according to their coarseness and allows the coarsest particles to drop substantially vertically.

The present invention is also embodied in apparatus for carrying out the above-mentioned method which includes a dispensing device which delivers the particles in a zone extending over the width of the web to be formed, comprising an advancing belt arranged below the dispensing device; a sifter arranged between the dispensing device and the belt, which can impart different motion components parallel to the forward direction of the belt, depending on the coarseness of the particles, to the particles falling from the dispensing device onto the belt and thereby force on the particles different parabolic trajectories; and a device for sorting out excessively large particles before they hit the belt, with the device for sorting out the particles formed by a transversal conveyer for the particles, which is arranged vertically under the dispensing device, below the sifter and above the belt.

So that the distribution of the particles can be influenced, it is advisable to make the effective width of the transversal conveyor variable.

In this manner, a variable range of the largest particles can be separated out of the spectrum of the size distribution.

Varying the effective width of the transversal conveyor can be accomplished by providing baffles above the edges of transversal conveyer; the baffles are inclined and are oriented toward the web, and the position of the baffles parallel to the forward travel direction can be varied.

Varying the position parallel to the forward direction can include a different inclination of the baffles about the transversal axis, or, also, a displacement, or a combined movement. Through variation, the width of the region, in which particles fall on the transversal conveyer and are transported away, is varied because of the inclination of the baffles the particles falling thereon get onto the belt carrying the mat being formed.

It is also advantageous if the height of the transversal conveyer above the mat is variable, so that in individual cases the transversal conveyer can be arranged so that the least possible disturbance of the sprinkling conditions occurs and no change has to be made to obtain optimum operation of the sprinkling device because of the presence of the transversal conveyor.

BRIEF DESCRIPTION OF THE DRAWING

The single FIGURE diagrammatically illustrates an air sifter sprinkling device shown according to the present invention.

DETAILED DESCRIPTION OF THE INVENTION

Unsorted particle material 1 is placed on a substantially horizontally advancing conveyor belt 2, which revolves endlessly over rolls 3 and 4. The material 1 is then smoothed out by rotating vanes 5, which revolve in the direction indicated, to form an even layer 6, which falls down, off the end of the conveyer belt 2, at the deflection roll 4 and toward a conveyor belt 10. The arrangement described so far constitutes a dispensing device for the particles forming the material.

The falling stream 7 of particles now arrives between two slit nozzle arrangements 8 and 9, which are disposed in a horizontal plane and are directed against each other, and through which the air is blown in opposite directions against the particle stream 7. Thereby, the falling particle stream 7 is sorted using the principle of an air sifter. This is done so that the particles sprinkled on the belt 10 produce a mat 11 which exhibits stratification in such a manner that when the mat 11 is compressed between two surfaces, the finest particles are adjacent the pressing surfaces, i.e., they lie on the surfaces of the sheet being produced, while the coarser particles are located in the center of the mat 11, and thus of the formed sheet.

With the forward direction 12 of the belt 10 indicated in the drawing the lightest particles 13 from the particle stream 7, inasfar as they have followed the effect of the slit nozzle 9, arrive on the belt 10 furthest to the left and form the lowest layer of the mat 11. The heavier particles 15, which follow a parabolic trajectory closer to the vertical, fall onto the layer of the finest particles 13 already formed and thereby begin to form an inner zone of the mat 11. This applies also to the heavier particles 16, inasfar as they have been deflected by the slit nozzle 8, and are deposited on the layer of the particles 15. The finest particles 17 deflected by the slit nozzle 8, finally, form the top layer of the mat 11.

The mat 11 is subsequently subjected to surface pressure. The finished sheet then has the finest particles 13 and 17 at its two surfaces, which is desirable for reasons of strength and surface quality.

The conveyor belt 2, the rotating vanes 5 and the slit nozzles 8 and 9, together, form the sprinkling device 18.

Below the slit nozzles 8, 9 and above the belt 10, about in the middle, a sorting device 20 for excessively coarse particles is arranged. The sorting device 20 comprises two beams 21 which are supported on both sides of the belt 10 and between which an endless conveyer belt 23 revolves over deflection rolls which are arranged parallel to the belt 10 and the travel direction 12. The beams 21, the rolls 22 and the conveyor belt 23 form a transversal conveyer 24. The particles 25 which drop down within the region of the width of the transversal conveyer 24, are collected by the latter and led off laterally without getting onto the mat 11.

Baffles 26, which extend over the width of the mat 11 and determine the effective width 27 of the transversal conveyer 24 and, thereby, the range of sizes of the particles to be sorted out, are arranged above the edges of the transversal conveyer 24. The particles striking the outside of the baffles 26 still reach the mat. As indicated by the flow line 28, they slide down over the baffles 26 which are inclined outward toward the mat 11. In order that the effective width 27 can be varied, the inclination of the baffles 26 can be varied, as is indicated by the dashed position 26'.

In addition, the transversal conveyer 24 can be raised or lowered as a whole, as is indicated by the dashed presentation 24'. The lifting device required for this purpose is not shown. As far as the air flow through the slit nozzles 8 and 9 is concerned, conditions exist which must be optimally adjusted for each kind of material 1 and should be interfered with as little as possible. This requirement is met by the height adjustment of the transversal conveyer 24.

What is claimed is:

1. Apparatus for forming a stratified layer, for the manufacture of sheets, from finely divided particles of material exhibiting a size distribution comprising:

(a) means for dispensing particles of the material over a zone of width equal to the width of sheet to be formed, in such a manner so that they fall freely downwardly;

(b) a belt advancing in a forward travel direction disposed below said means for dispensing;

(c) means disposed between said means for dispensing and said advancing belt, for applying horizontal forces to said particles falling downwardly to impart different motion components parallel to the forward travel direction of the belt to the particles freely falling down depending on the coarseness of the particles and, thereby, to force different parabolic trajectories thereon; and (d) means for sorting out and removing the coarsest particles before they strike the belt, whereby because of said different parabolic trajectories a stratified layer will be formed on said belt.

2. Apparatus according to claim 1 wherein said means for sorting out comprises a transversal conveyor for the particles which is arranged vertically under said means for dispensing and below said means for applying and the horizontal forces is above said belt.

3. Apparatus according to claim 2, and further including means to vary the effective width of the transverse conveyer.

4. Apparatus according to claim 3, wherein said means to vary said width comprise baffles disposed above the edges of the transversal conveyer directed at an angle outwardly toward the belt, said baffles supported such that their position is variable parallel to the forward travel direction of said belt.

5. Apparatus according to one of the claims 2 or 3, wherein said transversal conveyer is supported so that its height above said belt is variable.

* * * * *